US009399885B2

(12) United States Patent
Hoogland et al.

(10) Patent No.: US 9,399,885 B2
(45) Date of Patent: Jul. 26, 2016

(54) IMPACT RESISTANT FENESTRATION UNIT

(71) Applicant: Pella Corporation, Pella, IA (US)

(72) Inventors: Jonathan S. Hoogland, Pella, IA (US); Travis M. Eisenbarth, Pella, IA (US)

(73) Assignee: PELLA CORPORATION, Pella, IA (US)

( * ) Notice: Subject to any disclaimer, the term of this patent is extended or adjusted under 35 U.S.C. 154(b) by 0 days.

(21) Appl. No.: 14/552,805

(22) Filed: Nov. 25, 2014

(65) Prior Publication Data

US 2015/0143762 A1 May 28, 2015

Related U.S. Application Data

(60) Provisional application No. 61/908,620, filed on Nov. 25, 2013.

(51) Int. Cl.

| | |
|---|---|
| ***E06B 3/988*** | (2006.01) |
| ***E06B 1/40*** | (2006.01) |
| ***E06B 1/28*** | (2006.01) |
| ***E06B 1/30*** | (2006.01) |
| ***E06B 5/12*** | (2006.01) |

(52) U.S. Cl.

CPC ... *E06B 1/40* (2013.01); *E06B 1/28* (2013.01); *E06B 1/30* (2013.01); *E06B 5/12* (2013.01); *Y10T 29/49826* (2015.01)

(58) Field of Classification Search

CPC ..... E06B 1/18; E06B 1/16; E06B 1/40; E06B 1/28; E06B 1/30; E06B 5/12; Y10T 29/49826

USPC ..... 52/204.71, 204.7, 204.5, 656.6

See application file for complete search history.

(56) References Cited

U.S. PATENT DOCUMENTS

| | | | | |
|---|---|---|---|---|
| 3,081,849 | A * | 3/1963 | Hubbard | 52/464 |
| 3,196,992 | A * | 7/1965 | Owen | 52/204.57 |
| 3,340,663 | A * | 9/1967 | Collard | 52/775 |
| 5,379,560 | A * | 1/1995 | Steller | 52/204.7 |
| 5,444,958 | A * | 8/1995 | Lu | 52/775 |
| 5,555,684 | A * | 9/1996 | Galowitz et al. | 52/204.5 |
| 5,713,167 | A * | 2/1998 | Durham et al. | 52/204.54 |
| 5,771,640 | A * | 6/1998 | Back | 52/90.1 |
| 6,874,286 | B2 * | 4/2005 | Tavivian | 52/217 |
| 7,276,132 | B2 | 10/2007 | Davies et al. | |
| 8,245,462 | B2 * | 8/2012 | Miethe et al. | 52/204.7 |

* cited by examiner

*Primary Examiner* — Basil Katcheves

(74) *Attorney, Agent, or Firm* — Faegre Baker Daniels LLP

(57) ABSTRACT

A fenestration unit includes an outer frame portion, an inner frame portion and a supplemental fixation system that secures the outer frame portion to the inner frame portion. The supplemental fixation system increases a base force required to flex and release a complementary fit between a coupling feature of the outer frame portion and a retaining feature of the inner frame portion to a final force required to decouple the first and second frame portions.

9 Claims, 12 Drawing Sheets

IMPACT RESISTANT FENESTRATION UNIT

CROSS-REFERENCE TO RELATED APPLICATION

This application claims priority to Provisional Application No. 61/908,620, filed Nov. 25, 2013, which is herein incorporated by reference in its entirety.

BACKGROUND

Generally, an impact resistant window includes impact-resistant glass and a sturdy frame securely anchored to a building structure. Impact resistant windows are typically built with the goal of keeping extreme winds and associated debris from breaching the outer envelope of the associated structure. For example, hurricanes, tornadoes, and other weather events can give rise to conditions in which impact resistant windows are useful.

SUMMARY

Various inventive aspects relate to an impact resistant fenestration unit, such as a window or door. At least one of an inner and outer frame portion includes a retaining feature and the other of the inner and outer frame portions includes a receiving section that facilitates releasably securing the inner and outer frame portions. In some embodiments, a fenestration unit frame includes an outer frame portion, an inner frame portion and a supplemental fixation system that secures the outer frame portion to the inner frame portion. The outer frame portion includes a base and a receiving section, a base that is adapted to be secured within a building fenestration and a receiving section that includes a coupling feature. The inner frame portion includes an outer face, a glazing section and a retaining feature. The glazing section is adapted to retain a glazing panel and the retaining feature is adapted to engage the coupling feature of the outer frame portion in a complementary fit adapted to flex and release from the outer frame portion upon application of a base force on a glazing panel received in the glazing section. The supplemental fixation system is adapted to selectively adjust the base force required to decouple the inner and outer frame portions to a final force required to decouple the inner and outer frame portions.

Although various embodiments are specifically shown and described, the disclosure is meant to be illustrative of inventive aspects rather than limiting in nature with regard to inventive scope.

DETAILED DESCRIPTION

Figure 1:
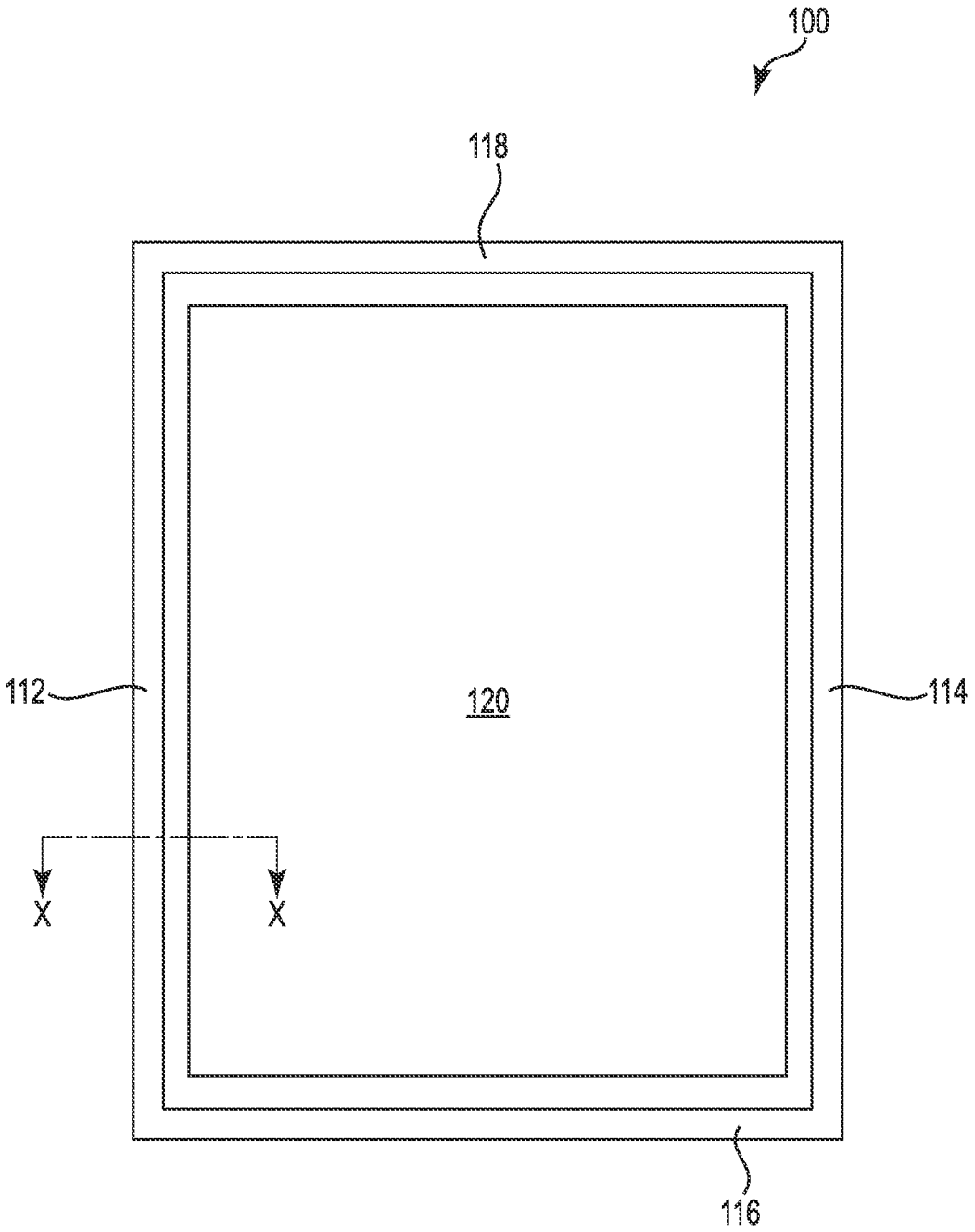
FIG. 1 is a front view of a window in accordance with some embodiments.

The disclosure pertains generally to an impact resistant fenestration unit and associated methods. As described herein, a fenestration unit can refer to any of a variety of structures, including but not limited to windows, doors, skylights, shutters and components thereof, such as window jambs, sills, heads, sash styles, sash rails, door thresholds and the like. In some embodiments, a fenestration unit can be a window such as a fixed frame window, a single-hung window, a double-hung window or a casement window. An "impact resistant" fenestration unit includes a fenestration unit that is resistant to desired impact forces, loading forces, or a combination of such forces. For illustrative purposes, FIG. 1 shows a fixed frame window 100, although the details described herein are applicable to any fenestration unit. Various embodiments are described with inner frame portions including retaining features and outer frame portions including receiving sections, the retaining features and receiving sections facilitating releasably securing the inner and outer frame portions. While receiving sections and retaining features are described in association with outer and inner frame portions, respectively, it should be understood components of the receiving sections and retaining features are optionally switched between the outer frame portion and the inner frame portion or alternated between the inner and outer frame portions, for example, according to various embodiments.

As shown, the window 100 includes a plurality of frame members including a first jamb 112, a second jamb 114, a sash 116, and a head 118. The window 100 also includes a glazing unit 120 which may be a single glazed or an insulated glass unit (IGU), for example. The IGU may be a multi glazed unit, for example. In some embodiments, the glazing unit 120 is a laminated structure in which two panes of glass are adhered together. In some embodiments, each of the frame members in a particular fenestration unit has a substantially similar cross-section, or profile. FIGS. 2-9 show examples of various cross-sections, or profiles, according to some embodiments.

In some embodiments, the window 100 includes various features similar to window products sold under the trade name "Impervia," "350 Series," or "Encompass," by Pella Corp. of Pella, Iowa or "XTherm 325" by EFCO of Monett, Mo. In some embodiments, one or more of the profiles of the frame members is formed of fiberglass composite material including a reinforcing mat structure, such as that described in U.S. Pat. No. 7,276,132 to Davies et al., "Method of Making a Reinforcing Mat for a Pultruded Part," issued Oct. 2, 2007, the entire contents of which are incorporated herein by reference for all purposes. In some embodiments, one or more of the profiles is formed of material sold under the trade name "DURACAST" fiberglass composite material available from Pella Corporation of Pella, Iowa.

Figure 2:
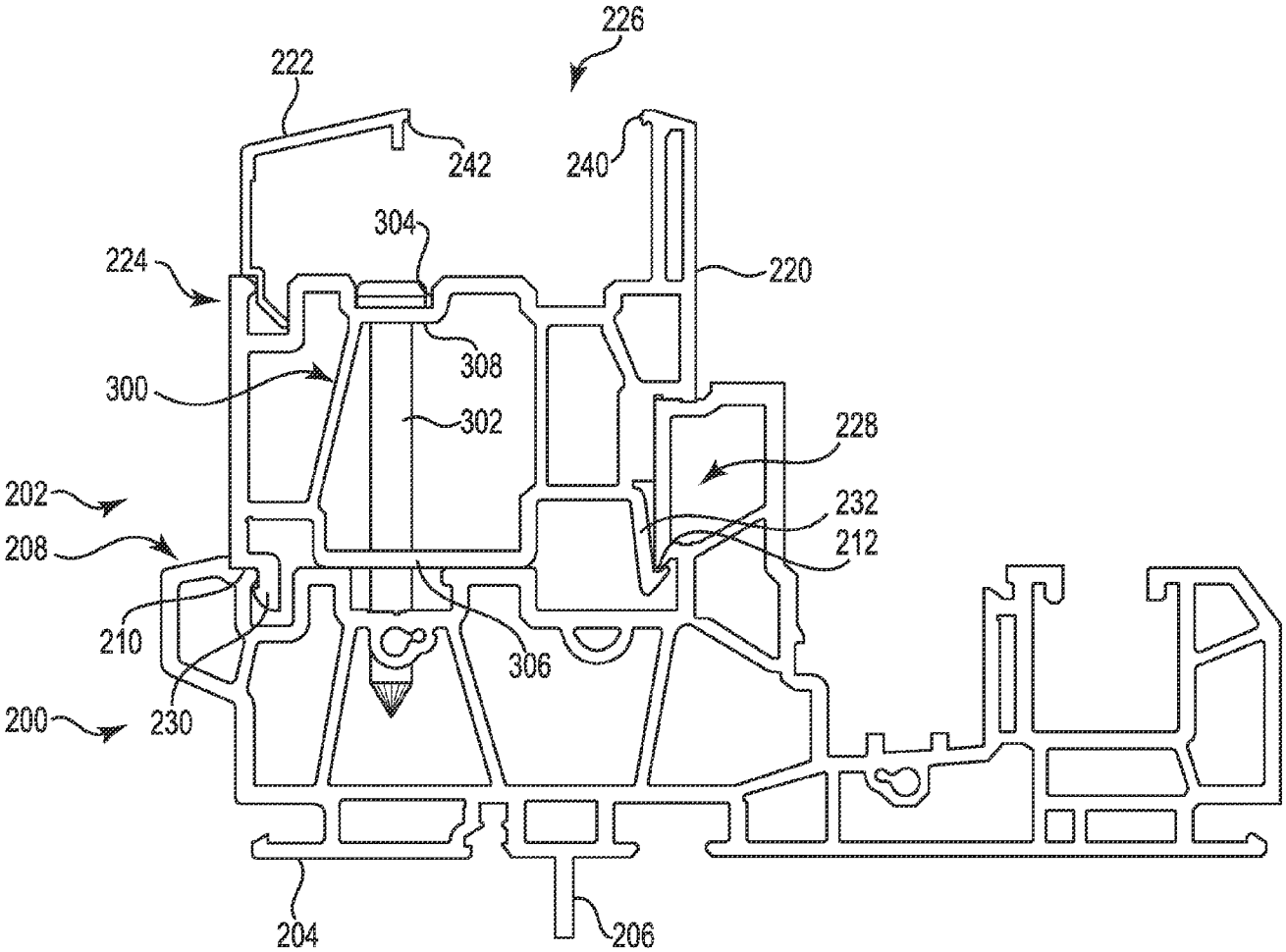
FIG. 2 is a schematic cross-section taken along line X-X of FIG. 1 in accordance with some embodiments.

FIG. 2 is a cross-section of the first jamb 112 along line X-X, according to some embodiments. As shown, the cross-section includes an outer frame member 200, also described as an outer frame portion 200, and an inner frame member 202, also described as an inner frame portion 202. In some embodiments, the outer frame member 200 includes a base 204 that is adapted to be secured within a building fenestration. In some embodiments, as illustrated, the base 204 includes a nailing flange 206. The nailing flange 206 may be secured to the building fenestration using nails, screws or the like. In some instances, the nailing flange 206 serves to help locate the fenestration unit 100 within the building fenestration.

Figure 3:
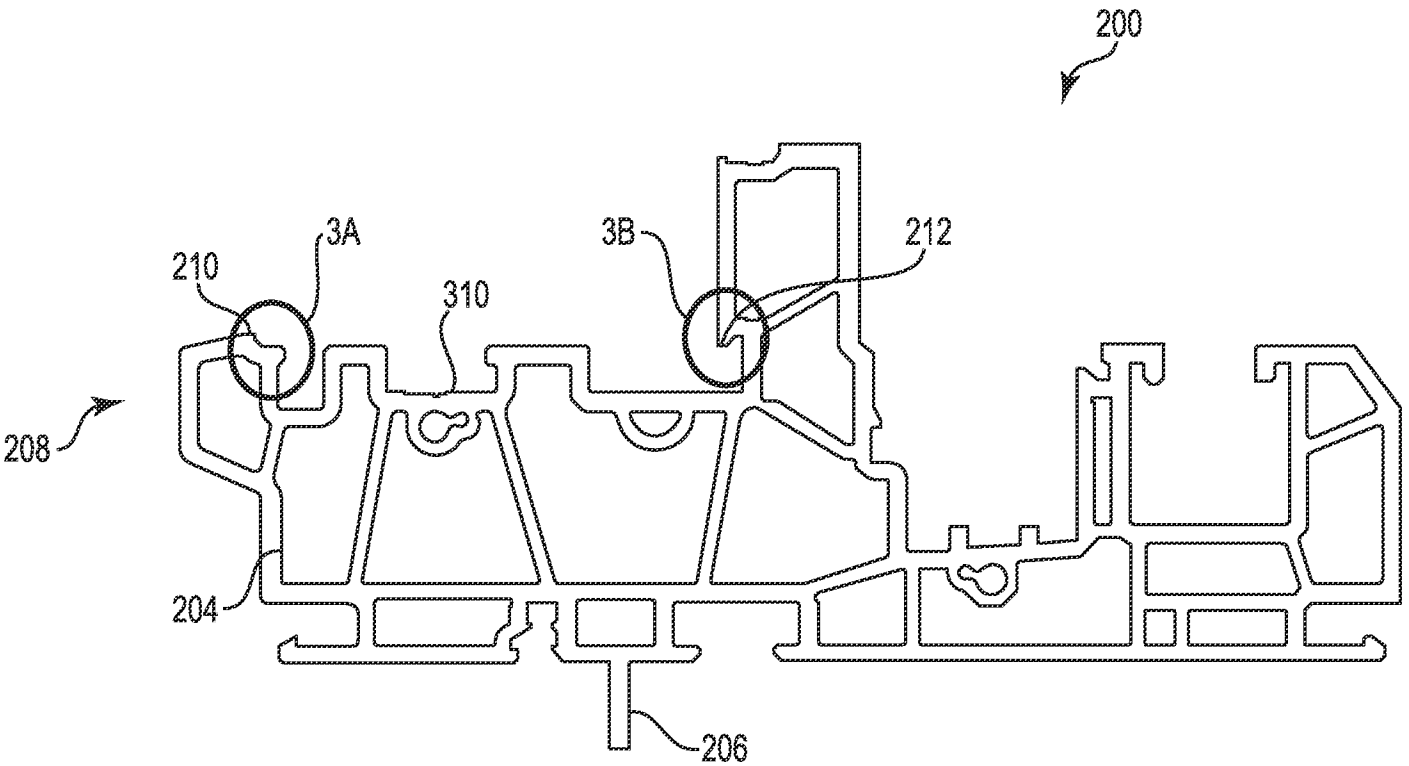
FIG. 3 is an illustration of a portion of FIG. 2 in accordance with some embodiments.
Figure 3B:
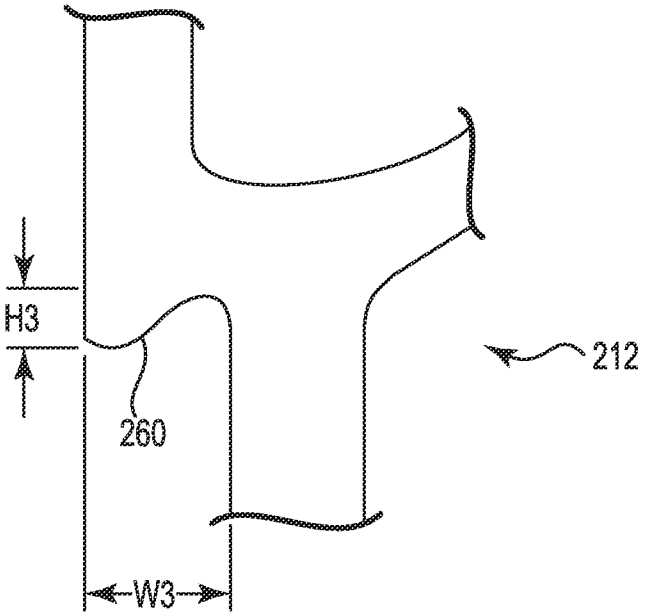
FIG. 3B is an illustration of a portion of FIG. 3 in accordance with some embodiments.
Figure 3A:
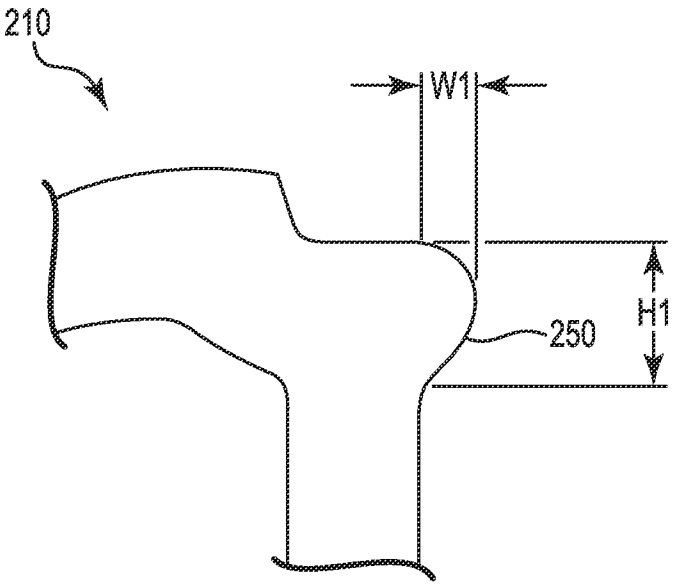
FIG. 3A is an illustration of a portion of FIG. 3 in accordance with some embodiments.

The outer frame member 200 also includes a receiving section 208 along a portion, selected portions, or substantially an entire length of the outer frame member 200. In some embodiments, as illustrated, the receiving section 208 includes an outer coupling feature 210 and an inner coupling feature 212. FIG. 3 provides an illustration of the outer frame member 200. FIG. 3A provides an enlarged view of the outer coupling feature 210 and FIG. 3B provides an enlarged view of the inner coupling feature 212.

Figure 4:
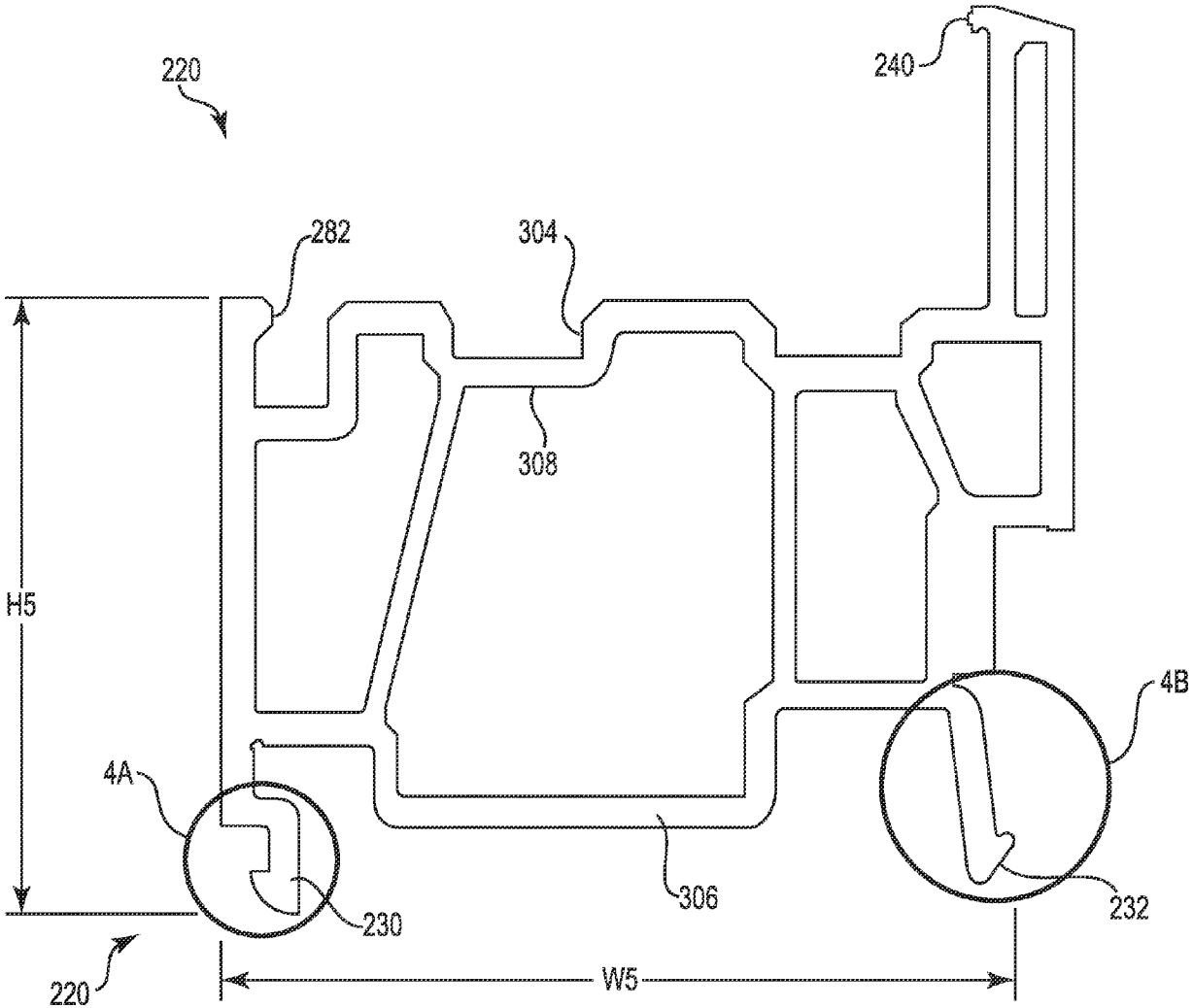
FIG. 4 is an illustration of a portion of FIG. 2 in accordance with some embodiments.
Figure 5:
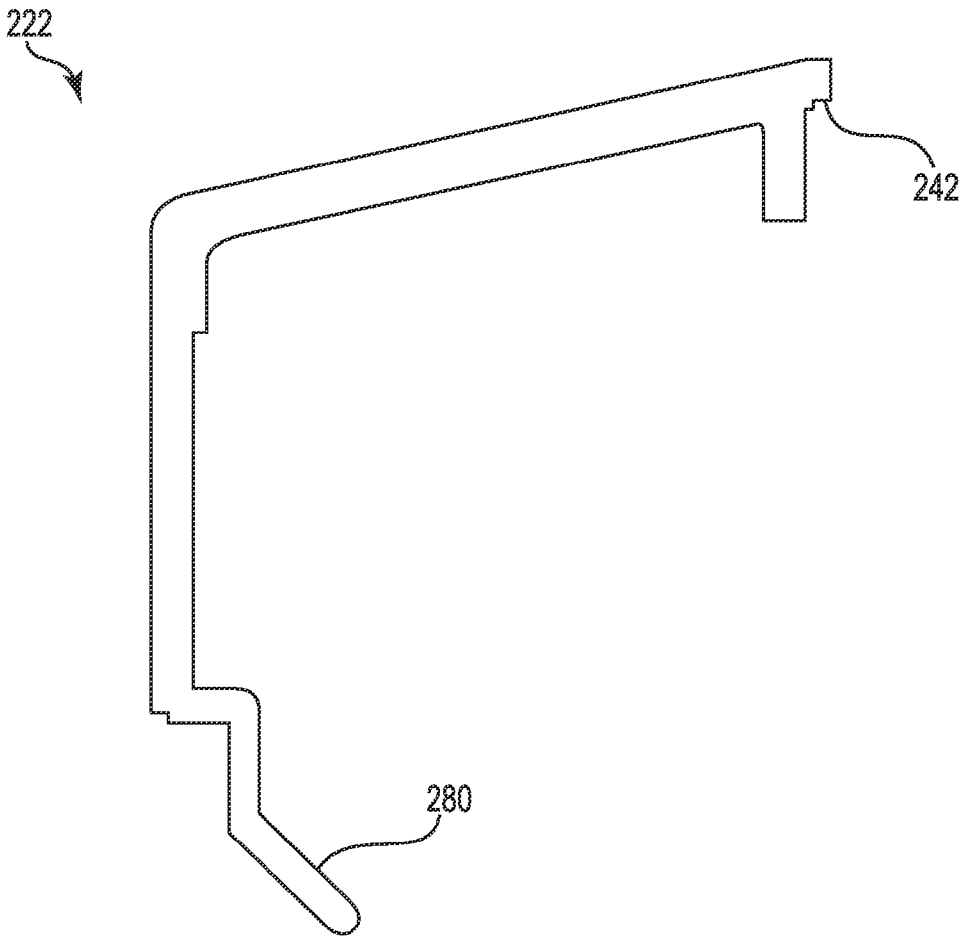
FIG. 5 is an illustration of a portion of FIG. 2 in accordance with some embodiments.

The inner frame member 202 includes a first profile 220 and a second profile 222. In some embodiments, the first profile 220 and the second profile 222 may be integrally molded, extruded or otherwise formed. In some embodiments, the second profile 222 may be formed independently of the first profile 220 and may subsequently be secured to the first profile 220 using any desired attachment technique. FIG. 4 provides an illustration of the first profile 220 while FIG. 5 provides an illustration of the second profile 222. As shown in FIG. 2, the inner frame member 202 includes an outer face 224. A glazing section 226 is adapted to retain a glazing panel (not shown in this view) such as the glazing unit 120 illustrated in FIG. 1. In some embodiments, the glazing section 226 is formed in combination by a first extension 240 of the first profile 220 and a second extension 242 of the second profile 222.

Figure 4B:
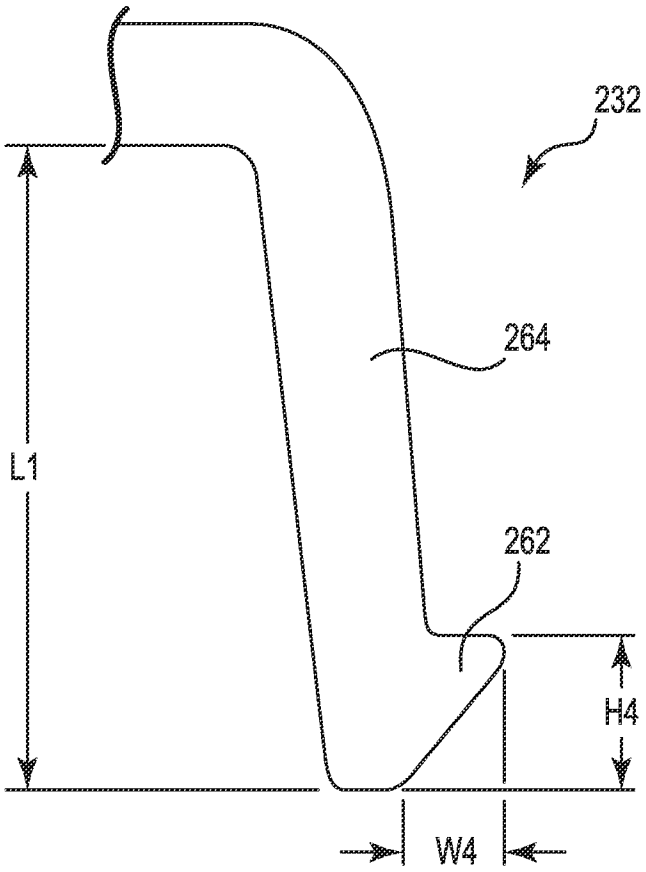
FIG. 4B is an illustration of a portion of FIG. 4 in accordance with some embodiments.
Figure 4A:
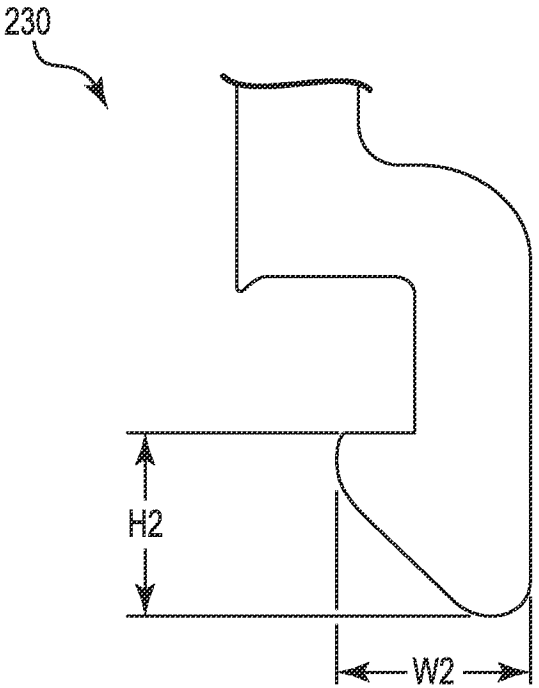
FIG. 4A is an illustration of a portion of FIG. 4 in accordance with some embodiments.

The inner frame member 202 includes a retaining feature 228 along a portion, selected portions, or substantially an entire length of the inner frame member 202. The retaining feature 228 is adapted to engage the coupling feature 210, 212 of the outer frame member 200 in a complementary fit that is adapted to flex and release upon application of a base force on the glazing unit 120. The base force is optionally defined as a base impact force (e.g., from flying objects), a base loading force (e.g., from wind loading), or a combination of both impact and loading forces according to some embodiments. In some embodiments, as illustrated, the retaining feature 228 includes an outer retention feature 230 that is adapted to engage the outer coupling feature 210 and an inner retention feature 232 that is adapted to engage the inner coupling feature 212. FIG. 4A provides an enlarged view of the outer retention feature 230 and FIG. 4B provides an enlarged view of the inner retention feature 232. In some embodiments, the complementary fit is a snap-fit between the receiving section 208 and the retaining feature 228.

FIG. 3A provides an enlarged view of the outer coupling feature 210, which is configured to releasably engage with the outer retention feature 230 shown in FIG. 4A. The outer coupling feature 210 includes an outer coupling surface 250 that is configured to engage with a corresponding outer hook 252 of the outer retention feature 230. In some embodiments, the outer coupling surface 250 is rounded, with a radius of curvature that ranges from about 0.02 inch to about 0.062 inch, for example, although other dimensions are contemplated. The outer coupling surface 250 can have a width W1 that ranges from about 0.01 inch to about 0.062 inch and a height H1 that ranges from about 0.02 inch to about 0.125 inch, for example, although other dimensions are contemplated. In some embodiments, the outer hook 252 can have a width W2 that ranges from about 0.05 inch to about 0.15 inch and a height H2 that ranges from about 0.05 inch to about 0.15 inch, for example, although other dimensions are contemplated.

FIG. 3B provides an enlarged view of the inner coupling feature 212, which is configured to releasably engage with the inner retention feature 232 shown in FIG. 4B. The inner coupling feature 212 includes an inner coupling surface 260 that is configured to engage with a corresponding inner hook 262 of the inner retention feature 232. In some embodiments, the inner coupling surface 260 is curved, having a width W3 that ranges from about 0.05 inch to about 0.15 inch and a height H3 that ranges from about 0.02 inch to about 0.06 inch, for example although other dimensions are contemplated. In some embodiments, the inner hook 262 has a width W4 that ranges from about 0.06 inch to about 0.1 inch and a height H4 that ranges from about 0.05 inch to about 0.15 inch, for example, although other dimensions are contemplated.

In some embodiments, as illustrated, the inner hook 262 is carried on an arm 264 having a length L1 that ranges from about 0.3 inch to about 0.5 inch, for example, although other dimensions are contemplated. The length L1 of the arm 264 can influence the relative holding power of the inner hook 262 to the inner coupling surface 260. As the length L1 is increased, or the arm 264 has a relatively narrower profile, the arm 264 will become more flexible. As the length L2 is decreased, or the arm 262 is made to have a relatively thicker profile, the arm 264 will become less flexible.

A supplemental fixation system 300 secures the outer frame member 200 to the inner frame member 202. In some embodiments, the supplemental fixation system 300 is adapted to increase the base force to a final force that is required to flex and release the complementary fit between the coupling features 210, 212 of the outer frame member 200 and the retaining feature 208 of the inner frame member 202. The final force is optionally defined as a final impact force (e.g., from flying objects), a final loading force (e.g., from wind loading), or a combination of both impact and loading forces according to some embodiments. In some embodiments, the supplemental fixation system 300 is configured to remain secured between the inner frame member 202 and the outer frame member 200 following release of the complementary fit between the coupling features 210, 212 and the retaining feature 208.

In some embodiments, the supplemental fixation system 300 includes one or more screws 302 that may extend through a portion of the inner frame member 202 and that may be threadedly engaged with a portion of the outer frame member 200. It will be appreciated that in the illustrated view, only one screw 302 is visible. While referring to a screw 302, it will be appreciated that the supplemental fixation system 300 may include one or more bolts, machine screws, wood screws, lag screws and the like.

In some embodiments, the screw 302 can be a pan head screw. Pan head screws can be obtained in a variety of sizes and lengths. A #4 pan head screw can have a head diameter of about 7/32 inches and a thread diameter of about 1/8 inch. A #6 pan head screw can have a head diameter of about 17/64 inches and a thread diameter of about 9/64 inches. A #8 pan head screw can have a head diameter of about 21/64 inches and a thread diameter of about 11/64 inches. A #10 pan head screw can have a head diameter of about 3/8 inches and a thread diameter of about 3/16 inches. A #12 pan head screw can have a head diameter of about 27/64 inches and a thread diameter of about 7/32 inches. A #14 pan head screw can have a head diameter of about 31/63 inches and a thread diameter of about ¼ inches.

In some embodiments, the number and relative spacing of the screws 302 may be varied to provide a desired increase in the final force relative to the base force. In a particular embodiment, the screws 302 can be spaced about 8 inches apart. If a greater increase in final force is desired, the screws 302 can be spaced closer together, such as every seven inches, every six inches, every five inches, or other dimension. If a lesser increase in final force is desired, the screws 302 can be spaced farther apart, such as every nine inches or every ten inches, or other dimension.

In some embodiments, screws can be selected having a particular length, diameter and strength. For a particular size screw, the screw can be formed of a high grade steel or a lower grade steel, or a different material, such as a plastic, and may have corresponding strength properties such as tensile yield strength and/or ultimate tensile strength. The tensile yield strength is the stress at which the fastener will permanently elongate about 0.2% (after force is removed) while the ultimate tensile strength is the stress at which the fastener fails.

With reference to FIG. 2, it can be seen that the screws 302 extend through both a top 304 and a bottom 306 of the first profile 220. In some embodiments, the top 304 includes an indentation 308 that is sized to accommodate the screw 302. In some embodiments, the indentation 308 includes an aperture that is about the same size as a diameter of the screw 302 and is optionally threaded to threadedly engage the screw 302 while in other embodiments the indentation 308 includes an aperture that is larger than the diameter of the screw 302. In some embodiments, the bottom 306 includes an aperture that is about the same size as a diameter of the screw 302 and is optionally threaded to threadedly engage the screw 302 while in other embodiments the indentation 308 includes an aperture that is larger than the diameter of the screw 302. By varying the relative sizes of the apertures in the indentation 308 and the bottom 306, the designer can regulate the relative flex between the first profile 220 and the outer frame member 200.

In some embodiments, the first profile 220 can have an overall width W5 between the outer retention feature 230 and the inner retention feature 232 that is in the range of about 1 inch to about 2.5 inches, although other dimensions are contemplated. In some embodiments, the first profile 220 can have a height H5, between the top 304 and the bottom 306, that is in the range of about 1 inch to about 2 inches, although other dimensions are contemplated. It will be appreciated that varying the width W5, particularly with respect to the height H5, can alter the flexibility of the fenestration unit 100 during application of a force.

With reference to FIG. 3, the screw 302 extends into and is threadedly engaged with a portion 310 of the outer frame member 200. When the glazing unit 120 is subjected to a force, the frame members, such as one or more of the first jamb 112, the second jamb 114, the sash 116, and the head 118 will remain rigid until either the glazing unit 120 itself breaks, thereby reducing the rigidity of the fenestration unit 100, or the pressure exerted on the window 100 exceeds the retention capability of the receiving section 208 and the retaining feature 228. The pressure at which the retention capability is exceeded may be referred to as the base force. In some embodiments, a suitable base force is in the range of about 2 pounds per lineal perimeter inch of frame to about 10 pounds per lineal perimeter inch of frame, for example.

In some embodiments, the inner retention feature 232 and the inner coupling feature 212 disengage upon application of a force, decreasing system rigidity and relieving pressure on the glazing unit 120 while the supplemental fixation system 300 substantially prevents the glazing unit 120 from a complete failure. Once the glazing unit 120 breaks, or during negative pressure loading, such as during a hurricane, the inner retention feature 232 will release from the inner coupling feature 212. The inner frame member 202 is retained to the outer frame member 200 via the outer retention feature 230 being engaged with the outer coupling feature 210 and via the supplemental fixation system 300.

In some embodiments, the supplemental fixation system 300 is not continuous, but instead includes a plurality of discrete fasteners such as screws 302. The supplemental fixation system 300 provides the fenestration unit 100 with a desired amount of flexibility as a result of providing a reduced moment arm, for example, which helps the glazing unit 120 withstand a higher force without suffering from a failure of the glazing that holds the pane(s) of glass within the glazing unit 120. This higher force may be referred to as the final force. In some embodiments, a suitable final force is in the range of about 2 pounds per lineal perimeter inch of frame to about 25 pounds per lineal perimeter inch of frame, for example.

FIG. 5 further illustrates features of the second profile 222. In some embodiments, the second profile 222 may be considered as being a glass stop and can be sized to accommodate a particular size and thickness of glazing unit 120. In some embodiments, the second profile 222 is snapped into place via a securement portion 280 that forms a frictional or compressive fit with a complementary pocket 282 (FIG. 4) within the first profile 220. This process can be referred to as face glazing, when the glass stop is added after the glazing unit 120 is inserted. In some embodiments, the second profile 222 may be integrally formed as part of the first profile 220, and the glazing unit 120 is then slid into the resulting groove. This is referred to as groove glazing.

Figure 6:
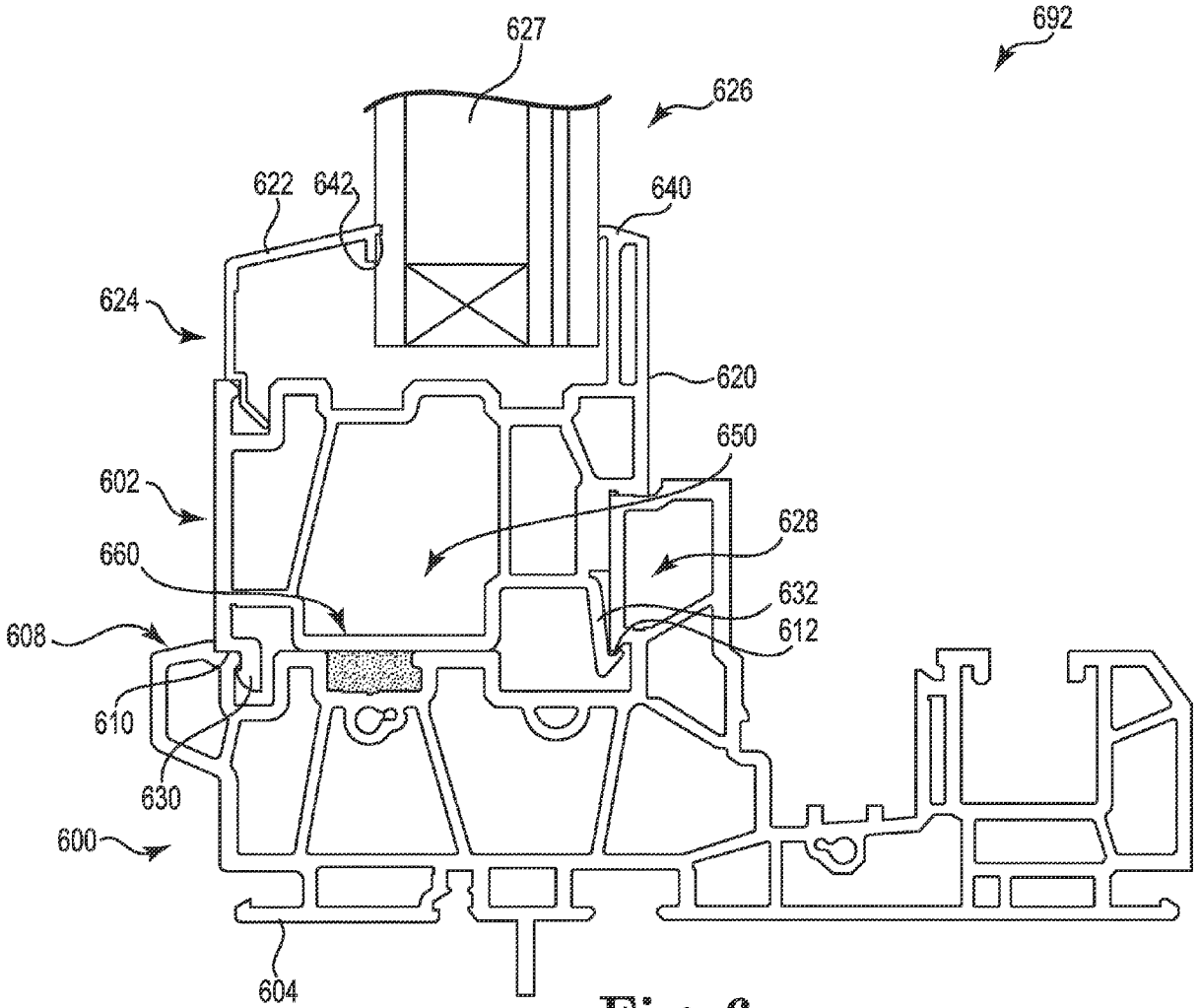
FIG. 6 is a schematic cross-section in accordance with some embodiments.

FIG. 6 is a schematic cross-section of a first jamb 692 along line X-X, including another supplemental fixation system 650 usable with various frame profiles in addition to or as an alternative to the supplemental fixation system 300, according to some embodiments. The first jamb 692 is optionally substantially similar to the first jamb 112. As shown, the cross-section includes an outer frame member 600, also described as an outer frame portion 600, and an inner frame member 602, also described as an inner frame portion 602. In some embodiments, the outer frame member 600 includes a base 604 that is adapted to be secured within a building fenestration.

The outer frame member 600 includes a receiving section 608 along a portion, selected portions, or substantially an entire length of the outer frame member 600. In some embodiments, as illustrated, the receiving section 608 includes an outer coupling feature 610 and an inner coupling feature 612. The inner frame member 602 includes a first profile 620 and a second profile 622. In some embodiments, the first profile 620 and the second profile 622 may be integrally molded, extruded or otherwise formed. In some embodiments, the second profile 622 may be formed independently of the first profile 620 and may subsequently be secured to the first profile 620 using any desired attachment technique.

As shown in FIG. 6, the inner frame member 602 includes an outer face 624. A glazing section 626 is adapted to retain a glazing panel (627) such as the glazing unit 120 illustrated in FIG. 1. In some embodiments, the glazing section 626 is formed in combination by a first extension 640 of the first profile 620 and a second extension 642 of the second profile 622.

The inner frame member 602 includes a retaining feature 628 along a portion, selected portions, or substantially an entire length of the inner frame member 602. The retaining feature 628 is adapted to engage the coupling feature 610, 612 of the outer frame member 600 in a complementary fit that is adapted to flex and release upon application of a base force on the glazing unit 120. In some embodiments, as illustrated, the retaining feature 628 includes an outer retention feature 630 that is adapted to engage the outer coupling feature 610 and an inner retention feature 632 that is adapted to engage the inner coupling feature 612. In some embodiments, the complementary fit is a snap-fit between the receiving section 608 and the retaining feature 628.

The supplemental fixation system 650 secures the outer frame member 600 to the inner frame member 602. In some embodiments, the supplemental fixation system 650 is adapted to increase the base force to a final force that is required to flex and release the complementary fit between the coupling features 610, 612 of the outer frame member 600 and the retaining feature 608 of the inner frame member 602.

In some embodiments, the supplemental fixation system 650 includes an adhesion region 660, located between the outer frame member 600 and the inner frame member 602, that is filled with a sealant or other adhesive. In some embodiments, the sealant or adhesive extends the length of the frame members 600, 602 while in other embodiments the sealant or adhesive is deposited in one or more discrete, separate locations along the length of the frame members 600, 602. For example, the region 660 optionally extends the length of the frame members 600, 602 as a continuous well for receiving sealant or adhesive, or is formed as a plurality of discrete, separated wells for containing sealant or adhesive. It will be appreciated that the relative amount of sealant or other adhesive within the adhesion region 660 can be varied to adjust the relative increase in the final force. In some embodiments, an adhesive having a relatively high strength can be used to provide a relatively larger increase in the final force. Optionally, a more flexible adhesive can be used to provide a relatively smaller increase in the final force. In some embodiments, the location of the adhesion region 660 can be adjusted to vary the relative increase in the final force. In some embodiments, the supplemental fixation system 650 can be used in combination with the supplemental fixation system 300, although this combination is not expressly illustrated.

Figure 7:
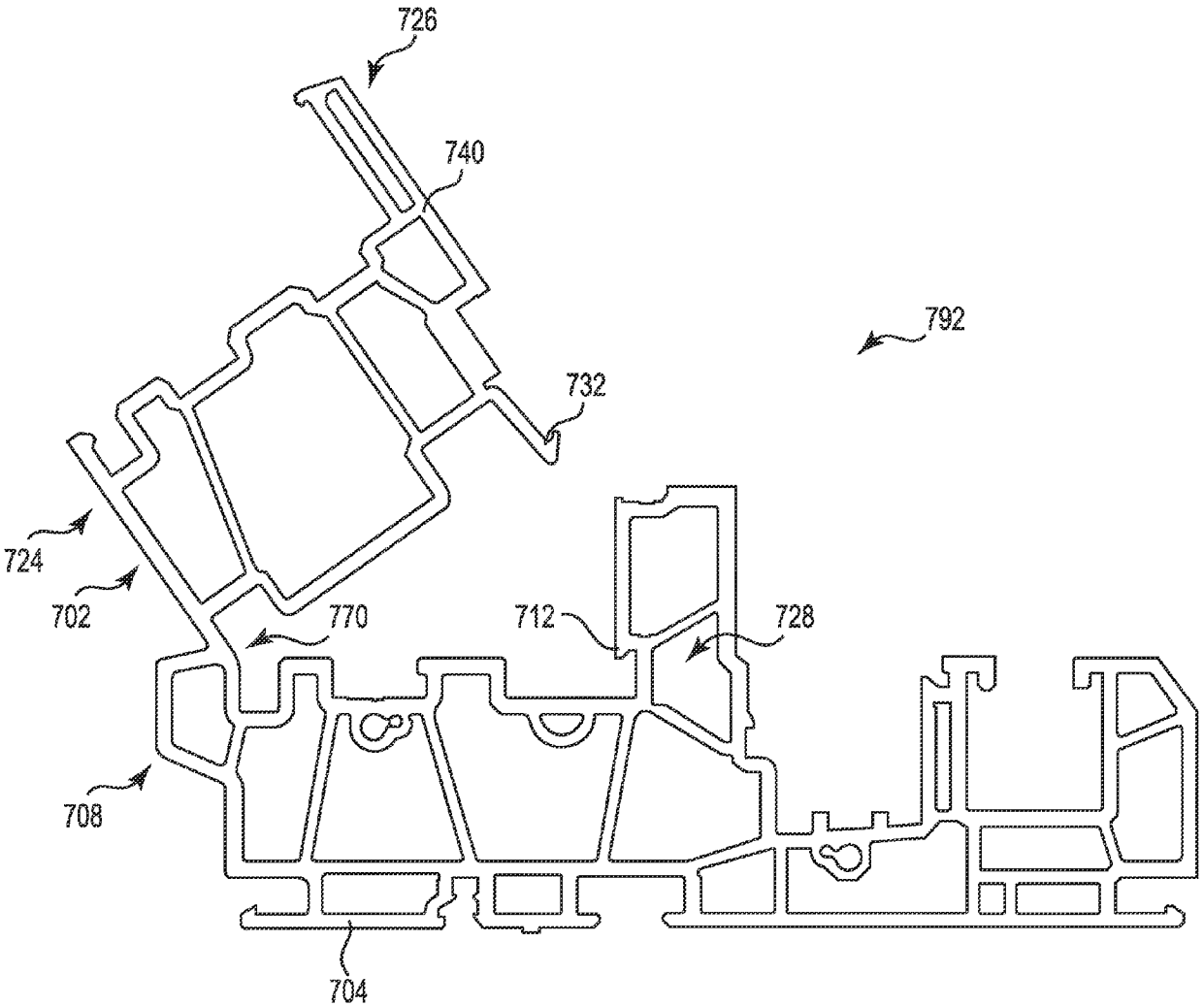
FIG. 7 is a schematic cross-section in accordance with some embodiments.

FIG. 7 is a schematic cross-section of a first jamb 792 along line X-X, including another supplemental fixation system 770 usable with various frame profiles in addition to or as an alternative to the supplemental fixation systems previously described, according to some embodiments. The first jamb 792 is optionally substantially similar to the first jambs previously described. As shown, the cross-section includes an outer frame member 700, also described as an outer frame portion 700, and an inner frame member 702, also described as an inner frame portion 702. In some embodiments, the outer frame member 700 includes a base 704 that is adapted to be secured within a building fenestration.

The outer frame member 700 includes a receiving section 708 along a portion, selected portions, or substantially an entire length of the outer frame member 700. In some embodiments, as illustrated, the receiving section 708 includes an inner coupling feature 712. In some embodiments, as illustrated, the receiving section 708 includes a hinge section 770 that hingedly secures the outer frame member 700 to the inner frame member 702.

The inner frame member 702 includes a retaining feature 728 along a portion, selected portions, or substantially an entire length of the inner frame member 702. The retaining feature 728 is adapted to engage the coupling feature 712 of the outer frame member 700 in a complementary fit that is adapted to flex and release upon application of a base force on the glazing unit 120. In some embodiments, as illustrated, the retaining feature 728 includes an inner retention feature 732 that is adapted to engage the inner coupling feature 712. In some embodiments, the complementary fit is a snap-fit between the receiving section 708 and the retaining feature 728.

In some embodiments, the hinge 770 disposed between the outer frame member 700 and the inner frame member 702 functions as a supplemental fixation system as the hinge 770 prevents complete separation of the inner frame member 702 from the outer frame member 700. In some embodiments, while not expressly illustrated, this embodiment can include a supplemental fixation system such as the supplemental fixation system 300 (FIG. 2) or the supplemental fixation system 650 (FIG. 6), for example. If present, the supplemental fixation system is adapted to increase the base force to a final force that is required to flex and release the complementary fit between the outer frame member 700 and a retaining feature such as retaining feature 608 of the inner frame member 602.

Figure 8:
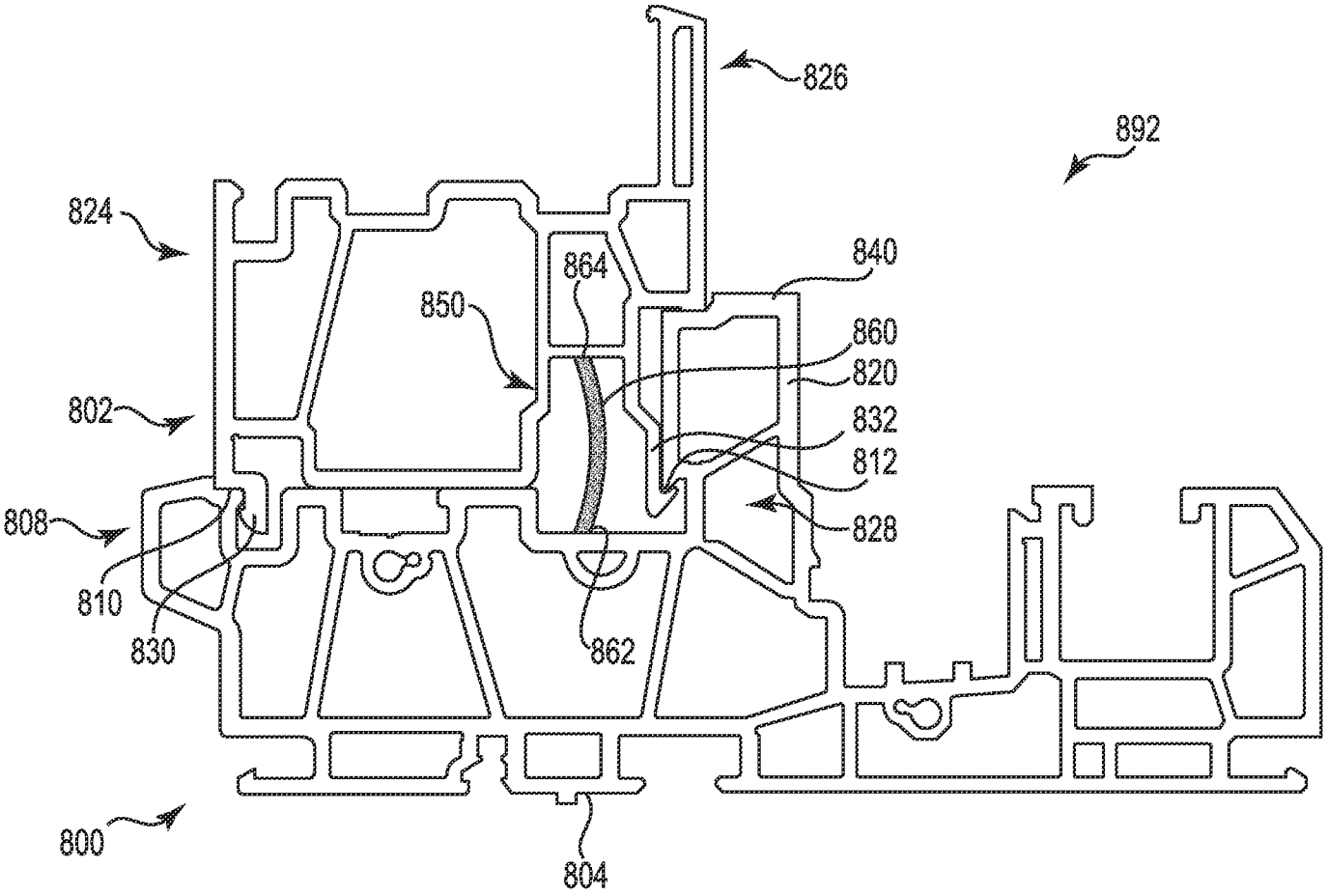
FIG. 8 is a schematic cross-section in accordance with some embodiments.

FIG. 8 is a schematic cross-section of a first jamb 892 along line X-X, including another supplemental fixation system 850 usable with various frame profiles in addition to or as an alternative to the supplemental fixation systems previously described, according to some embodiments. The first jamb 892 is optionally substantially similar to the first jambs previously described. As shown, the cross-section includes an outer frame member 800, also described as an outer frame portion 800, and an inner frame member 802, also described as an inner frame portion 802. In some embodiments, the outer frame member 800 includes a base 804 that is adapted to be secured within a building fenestration.

The outer frame member 800 includes a receiving section 808 along a portion, selected portions, or substantially an entire length of the outer frame member 800. In some embodiments, as illustrated, the receiving section 808 includes an outer coupling feature 810 and an inner coupling feature 812. The inner frame member 802 includes a retaining feature 828 along a portion, selected portions, or substantially an entire length of the inner frame member 802. The retaining feature 828 is adapted to engage the coupling feature 810, 812 of the outer frame member 800 in a complementary fit that is adapted to flex and release upon application of a base force on the glazing unit 120.

In some embodiments, as illustrated, the retaining feature 828 includes an outer retention feature 830 that is adapted to engage the outer coupling feature 810 and an inner retention feature 832 that is adapted to engage the inner coupling feature 812. In some embodiments, the complementary fit is a snap-fit between the receiving section 808 and the retaining feature 828. Optionally, the inner frame member 802 may instead be hingedly secured to the outer frame member 800.

The supplemental fixation system 850 secures the outer frame member 800 to the inner frame member 802. In some embodiments, the supplemental fixation system 850 is adapted to increase the base force to a final force that is required to flex and release the complementary fit between the coupling features 810, 812 of the outer frame member 800 and the retaining feature 808 of the inner frame member 802.

In some embodiments, the supplemental fixation system 850 includes a tether 860 that extends between a first end 862 secured to the outer frame member 800 and a second end 864 secured to the inner frame member 802. In some embodiments, the tether 860 can be adhesively secured at either end 862, 864. In some embodiments, the tether 860 can be co-extruded with the outer frame member 800 and the inner frame member 802. It will be appreciated that the dimensions and relative location of the tether 860 can be varied in order to adjust the relative increase in the final force. In some embodiments, the materials used to form the tether 860 can be varied in order to adjust the relative increase in the final force.

Figure 9:
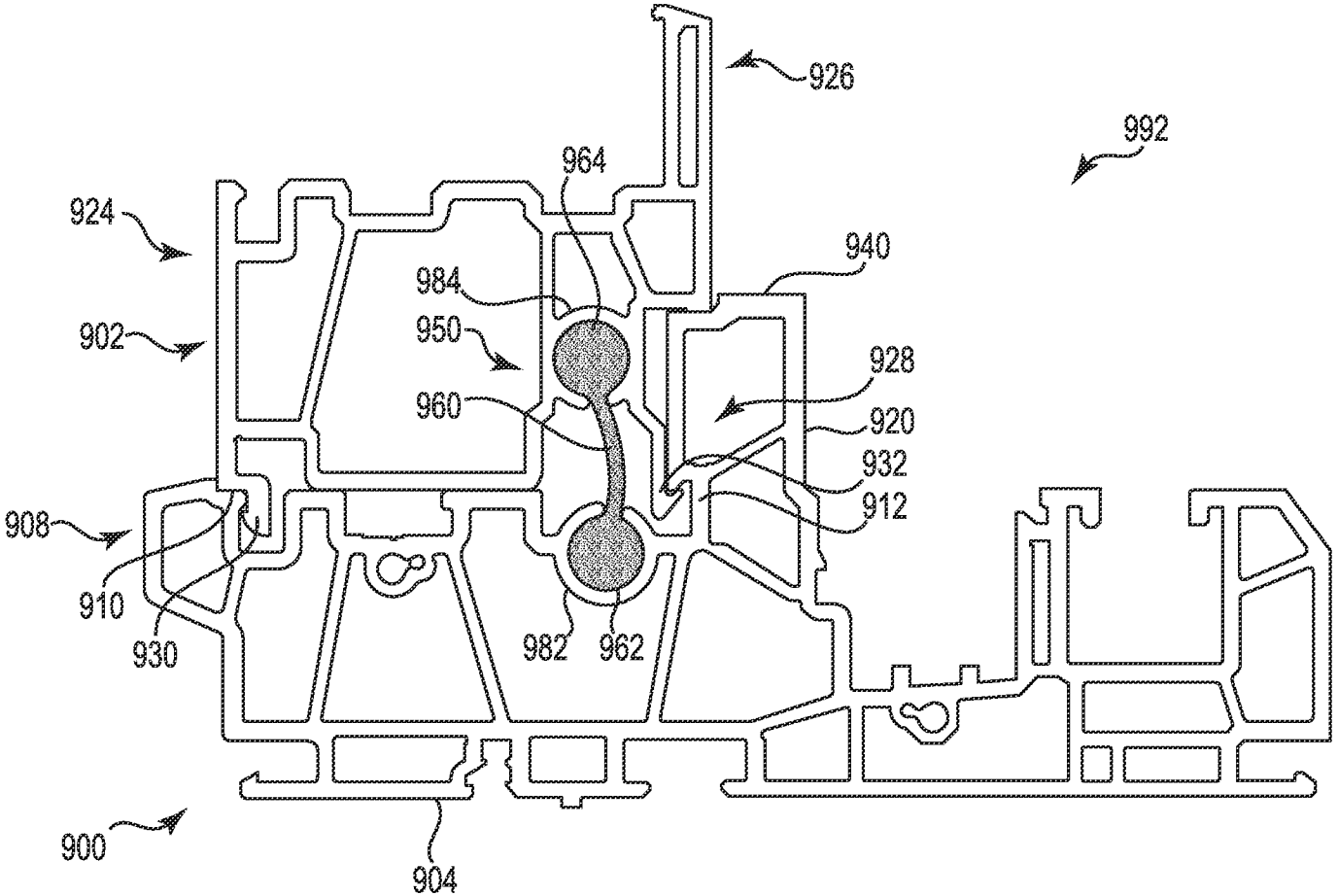
FIG. 9 is a schematic cross-section in accordance with some embodiments.

FIG. 9 is a schematic cross-section of a first jamb 992 along line X-X, including another supplemental fixation system 950 usable with various frame profiles in addition to or as an alternative to the supplemental fixation systems previously described, according to some embodiments. The first jamb 992 is optionally substantially similar to the first jambs previously described. As shown, the cross-section includes an outer frame member 900, also described as an outer frame portion 900, and an inner frame member 902, also described as an inner frame portion 902. In some embodiments, the outer frame member 900 includes a base 904 that is adapted to be secured within a building fenestration.

The outer frame member 900 includes a receiving section 908 along a portion, selected portions, or substantially an entire length of the outer frame member 900. In some embodiments, as illustrated, the receiving section 908 includes an outer coupling feature 910 and an inner coupling feature 912. The inner frame member 902 includes a retaining feature 928 along a portion, selected portions, or substantially an entire length of the inner frame member 902. The retaining feature 928 is adapted to engage the coupling feature 910, 912 of the outer frame member 900 in a complementary fit that is adapted to flex and release upon application of a base force on the glazing unit 120.

In some embodiments, as illustrated, the retaining feature 928 includes an outer retention feature 930 that is adapted to engage the outer coupling feature 910 and an inner retention feature 932 that is adapted to engage the inner coupling feature 912. In some embodiments, the complementary fit is a snap-fit between the receiving section 908 and the retaining feature 928. Optionally, the inner frame member 902 may instead be hingedly secured to the outer frame member 900.

The supplemental fixation system 950 secures the outer frame member 900 to the inner frame member 902. In some embodiments, the supplemental fixation system 950 is adapted to increase the base force to a final force that is required to flex and release the complementary fit between the coupling features 910, 912 of the outer frame member 900 and the retaining feature 908 of the inner frame member 902.

In some embodiments, the supplemental fixation system 950 includes a geometrically keyed structure 960 that extends between a first end 962 secured to the outer frame member 900 and a second end 964 secured to the inner frame member 902. In some embodiments, the geometrically keyed structure 960 can be frictionally secured at either end 962, 964. In the illustrated embodiment, the first end 962 of the geometrically keyed structure 960 fits into an aperture 982 formed in the outer frame member 900 and the second end 964 of the geometrically keyed structure 960 fits into an aperture 984 formed in the inner frame member 902. In some embodiments, the geometrically keyed structure 960 can be slid into place. It will be appreciated that the dimensions and relative location of the geometrically keyed structure 960 can be varied in order to adjust the relative increase in the final force. In some embodiments, the materials used to form the geometrically keyed structure 960 can be varied in order to adjust the relative increase in the final force. In some embodiments, hooks or T-slots can be used to secure the geometrically keyed structure 960 in place.

Figure 10:
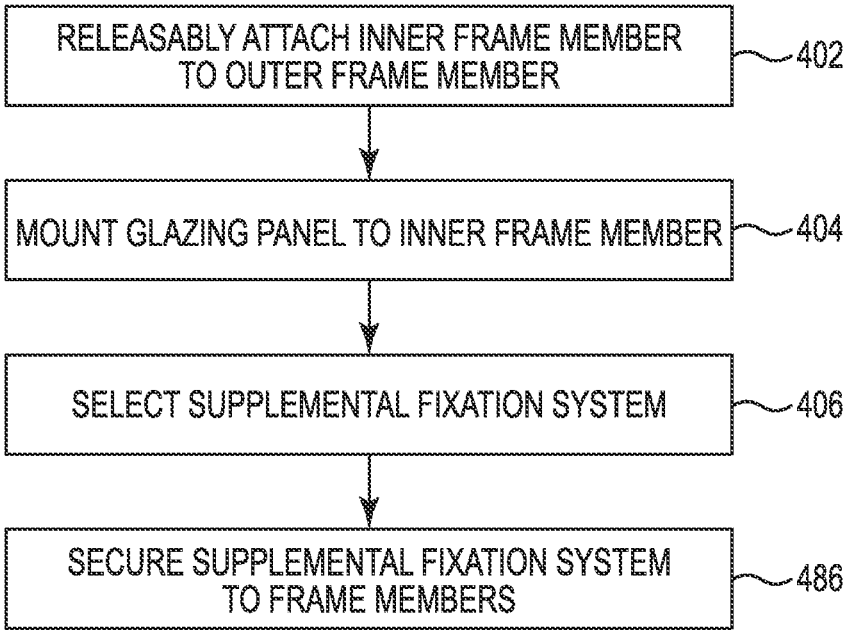
FIG. 10 illustrates a method in accordance with some embodiments.

FIG. 10 describes a method in accordance with some embodiments. An inner frame member, such as the inner frame member 202, 602, 702, 802 or 902, is releasably attached to an outer frame member such as the outer frame member 200, 600, 700, 800 or 900 as generally indicated at block 402. The inner frame member may be secured to the outer frame member by engaging a coupling feature of the outer frame member with a retaining feature of the inner frame member in a complementary fit. As indicated at block 404, a glazing panel may be mounted to the inner frame member. A supplemental fixation system such as the supplemental fixation system 300, 650, 850 or 950 may be selected to provide a desired final force (relative to a base force absent the supplemental fixation system) as generally indicated at block 406. The supplemental fixation system may be secured to the inner frame member and the outer frame member, as generally indicated at block 408.

Various modifications and additions can be made to the exemplary embodiments discussed without departing from the scope of the present invention. For example, while receiving sections and retaining features are described in association with outer and inner frame portions, respectively, it should be understood that the receiving sections and retaining features are optionally switched from the outer frame member to the inner frame member and vice versa. In view of at least the foregoing, it should be understood that, while the embodiments described above refer to particular features, the scope of this invention also includes embodiments having different combinations of features and embodiments that do not include all of the above described features.

The following is claimed:

1. A fenestration unit assembly, having an exterior face and an interior face, comprising:

a glazing unit; and a frame having an exterior side corresponding to the exterior face of the fenestration unit assembly and an interior side corresponding to the interior face of the fenestration unit assembly including:

an outer frame portion having a base and a receiving section, the base being adapted to be received in a building fenestration in a building structure and adapted to be fixed to the building structure and the receiving section including a first coupling feature located at a second exterior location toward the exterior side of the frame;

an inner frame portion secured to the outer frame portion at a first interior location toward the interior side of the frame and the second exterior location such that the inner frame portion is configured to release from the outer frame portion upon application of a base force on the exterior face of the fenestration unit assembly, the inner frame portion having an outer face, a glazing section, and a first retaining feature at the second exterior location, the glazing section securing the glazing unit to the inner frame portion and the first retaining feature being adapted to engage the first coupling feature of the outer frame portion in a complementary fit adapted to flex and release upon application of the base force on the fenestration unit assembly; and a supplemental fixation system securing the outer frame portion to the inner frame portion, the supplemental fixation system located between the first interior location and the second exterior location and adapted to increase the base force required to flex and release the complementary fit to a final force required to release the inner and outer frame portions.

2. The fenestration unit assembly of claim 1, wherein the supplemental fixation system includes a fastener.

3. The fenestration unit assembly of claim 1, wherein the supplemental fixation system comprises a screw.

4. The fenestration unit assembly of claim 1, wherein the supplemental fixation system comprises an adhesive or sealant disposed between the inner frame portion and the outer frame portion.

5. The fenestration unit assembly of claim 1, wherein the supplemental fixation system comprises a geometrically keyed system extending between the inner frame portion and the outer frame portion.

6. The fenestration unit assembly of claim 1, wherein the inner frame portion is hingedly secured to the outer frame portion.

7. The fenestration unit assembly of claim 1, wherein the inner frame portion is hingedly secured to the outer frame portion along a side of the fenestration unit assembly such that upon release of the complimentary fit of the inner frame portion from the outer frame portion the inner frame portion remains tethered to the outer frame portion.

8. A method of making a fenestration unit assembly having an exterior face and an interior face, the method comprising:

providing inner and outer frame portions of a frame having an exterior side corresponding to the exterior face of the fenestration unit assembly and an interior side corresponding to the interior face of the fenestration unit assembly, the outer frame portion having an inner periphery, a base and a receiving section, the receiving section including a first interior location toward the interior side of the frame and a first coupling feature located at a second exterior location toward the exterior side of the frame, and the inner frame portion having an outer periphery, an outer face, a first retaining feature located at the second exterior location, and a glazing section adapted to be secured to a glazing panel;

providing a glazing panel having an interior side and an exterior side;

attaching the inner frame portion at the outer periphery to the outer frame portion inner periphery, the first coupling feature of the outer frame portion with the first retaining feature of the inner frame portion in a complementary fit adapted to flex and release upon application of a base force on the exterior face of the fenestration unit assembly;

mounting the glazing panel to the inner frame portion;

providing a supplemental fixation system selected based upon a desired final force required to decouple the inner and outer frame portions following flexing and release of the complementary fit between the retaining and coupling features; and securing the supplemental fixation system to the inner and outer frame portions between the first interior and second exterior locations.

9. The method of claim 8, wherein selecting a supplemental fixation system based upon a desired final force includes selecting a number of fasteners and a separation distance between the fasteners for achieving the desired final force.

* * * * *